US011610552B2

(12) United States Patent
Sohn et al.

(10) Patent No.: US 11,610,552 B2
(45) Date of Patent: Mar. 21, 2023

(54) DISPLAY DEVICE

(71) Applicant: SAMSUNG DISPLAY CO., LTD., Yongin-si (KR)

(72) Inventors: Young Soo Sohn, Yongin-si (KR); Ki Hyun Pyun, Yongin-si (KR); Jae Hyoung Park, Yongin-si (KR); Kwan Young Oh, Yongin-si (KR); Seung Young Choi, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/343,808

(22) Filed: Jun. 10, 2021

(65) Prior Publication Data

US 2022/0076636 A1 Mar. 10, 2022

(30) Foreign Application Priority Data

Sep. 8, 2020 (KR) ..... 10-2020-0114951

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/08* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 9,336,742 | B2 | 5/2016 | Ahn et al. | |
| 2014/0043306 | A1* | 2/2014 | Min | G09G 3/3677 345/204 |
| 2014/0347344 | A1 | 11/2014 | Lee et al. | |
| 2015/0022512 | A1* | 1/2015 | Ahn | G09G 3/3614 345/212 |
| 2016/0307543 | A1* | 10/2016 | Lim | G09G 3/20 |
| 2016/0358576 | A1* | 12/2016 | Lee | G09G 3/3674 |
| 2017/0047016 | A1* | 2/2017 | Son | G09G 3/20 |
| 2019/0295474 | A1 | 9/2019 | Kim et al. | |
| 2021/0035518 | A1* | 2/2021 | Yabuki | G09G 3/3677 |

FOREIGN PATENT DOCUMENTS

| | | | |
|---|---|---|---|
| KR | 101597755 | B1 | 2/2016 |
| KR | 1020190110661 | A | 10/2019 |
| KR | 102145391 | B1 | 8/2020 |

* cited by examiner

*Primary Examiner* — Christopher J Kohlman
(74) *Attorney, Agent, or Firm* — Cantor Colburn LLP

(57) ABSTRACT

A display device of the present invention includes a pixel unit including a plurality of pixels connected to data lines and scan lines; a data driver disposed on one side of the pixel unit to drive the data lines; a scan driver disposed on the one side of the pixel unit together with the data driver to drive the scan lines; and a controller which controls an output timing of a data signal in units of pixel columns and units of pixel rows based on a load of a scan signal supplied to the scan lines and a load of the data signal supplied to the data lines.

19 Claims, 10 Drawing Sheets

DISPLAY DEVICE

The application claims priority to Korean Patent Application No. 10-2020-0114951, filed on Sep. 8, 2020, and all the benefits accruing therefrom under 35 U.S.C. § 119, the content of which in its entirety is herein incorporated by reference.

BACKGROUND

Field

The present invention relates to a display device.

Discussion

In general, a display device has a structure in which a scan driver is disposed on one side of a pixel unit and a data driver is disposed on the other side. Recently, a structure for implementing a narrow bezel in which non-display areas on opposite sides of the display device are minimized is being developed. For example, in order to implement the narrow bezel, a panel of a single side driving method in which the scan driver and the data driver are disposed together on one side is being studied.

SUMMARY

In the display device of the single side driving method, scan lines may have different lengths. Due to the structure of these wirings, an RC load corresponding to each position of the pixel unit may be non-uniform, and a timing at which a scan signal and a data signal are supplied to each of pixels may not be synchronized. Accordingly, a deviation in data charging rate may occur and display quality may deteriorate.

An aspect of the present invention is to provide a display device in which a deviation in charging rate of a data signal is reduced.

A display device according to embodiments of the present invention includes: a pixel unit including a plurality of pixels connected to data lines and scan lines; a data driver disposed on one side of the pixel unit to drive the data lines; a scan driver disposed on the one side of the pixel unit together with the data driver to drive the scan lines; and a controller which controls an output timing of a data signal in units of pixel columns and units of pixel rows based on a load of a scan signal supplied to the scan lines and a load of the data signal supplied to the data lines.

In an embodiment, each of the scan lines may include: a main scan line extending in a first direction and connected to pixels in a corresponding pixel row among the plurality of pixels; a first sub-scan line connected to the main scan line at a first contact point and extending in a second direction different from the first direction; and a second sub-scan line connected to the main scan line at a second contact point and extending in the second direction.

In an embodiment, the controller may control the output timing of the data signal according to a distance between the scan driver and the main scan line connected to the pixels and in the corresponding pixel row.

In an embodiment, the load of the scan signal may increase, as the distance between the scan driver and the main scan line connected to the pixels in the corresponding pixel row increases.

In an embodiment, the controller may adjust the output timing of the data signal for each of the scan lines according to a position of a target pixel connected to the main scan line in the first direction, and the target pixel may be included in the pixels in the corresponding pixel row.

In an embodiment, the controller may adjust the output timing of the data signal based on a distance between the target pixel and the first contact point and a distance between the target pixel and the second contact point.

In an embodiment, the load of the scan signal may increase, as the distance between the target pixel and the first contact point increases or the distance between the target pixel and the second contact point increases.

In an embodiment, the controller may control the output timing of the data signal according to a distance between the data driver and a target pixel connected to the data lines among the pixels in the corresponding pixel row.

In an embodiment, the load of the data signal may increase, as the distance between the target pixel and the data driver increases.

In an embodiment, a length of each of first sub-scan lines and second sub-scan lines of the scan lines in the second direction may gradually increase along the first direction.

In an embodiment, the controller may generate a timing control signal for controlling the output timing of the data signal and supply the timing control signal to the data driver.

In an embodiment, the data driver may delay the data signal by a positive delay value or a negative delay value based on the timing control signal.

In an embodiment, the data driver may delay the data signal by the negative delay value based on the timing control signal when a supply timing of the data signal is later than a supply timing of the scan signal.

In an embodiment, the data driver may delay the data signal by the positive delay value based on the timing control signal when a supply timing of the data signal is earlier than a supply timing of the scan signal.

In an embodiment, the data driver may output the data signal without delaying the data signal based on the timing control signal when the supply timing of the data signal and the supply timing of the scan signal coincide with each other.

In an embodiment, the controller may set a predetermined number of adjacent pixel rows among the pixel rows as a pixel row block, the pixel row block being provided in plural, and control the output timing of the data signal in units of the pixel row blocks.

In an embodiment, the controller may set a predetermined number of adjacent pixel columns among the pixel columns as a pixel column block, the pixel column block being provided in plural, and control the output timing of the data signal in units of the pixel column blocks.

In an embodiment, the timing control signal may include a look-up table for storing delay values of the data signal according to relative positions of the plurality of pixels in the pixel unit.

In an embodiment, the data driver may change a length of a horizontal blank period based on the timing control signal.

In an embodiment, the data signal may be delayed by the positive delay value when the length of the horizontal blank period increases, and the data signal may be delayed by the negative delay value when the length of the horizontal blank period decreases.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
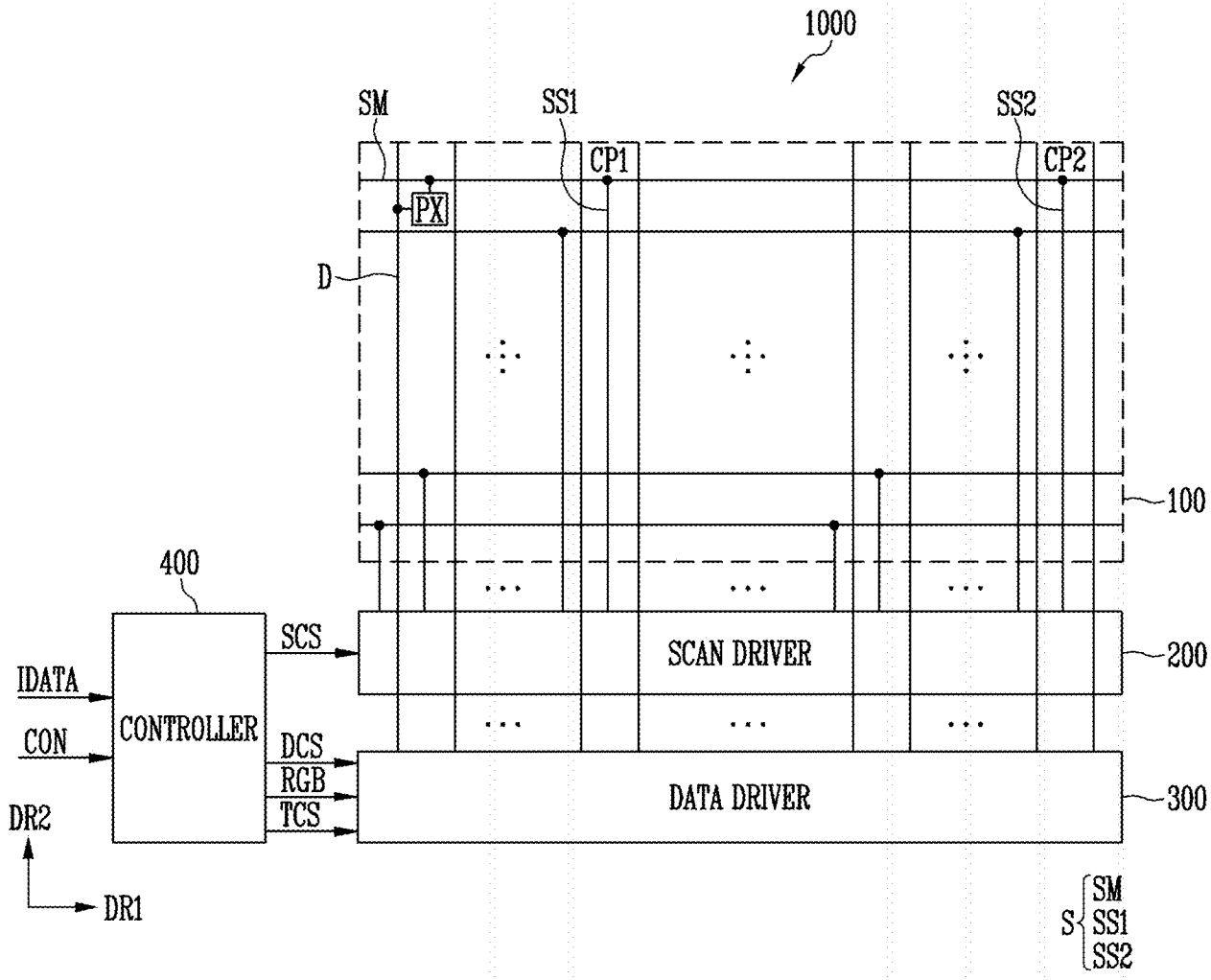
FIG. 1 is a block diagram illustrating a display device according to embodiments of the present invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

In describing the drawings, similar reference numerals are used for similar element. In the accompanying drawings, the sizes of elements may be shown to be enlarged than the actual for clarity of the present invention. It will be understood that, although the terms "first", "second", etc. may be used herein to describe various elements, these elements should not be limited by these terms. These terms are only used to distinguish one element from another element. For instance, a first element discussed below could be termed a second element without departing from the scope of the present invention. Similarly, the second element could also be termed the first element. In the disclosure, the singular forms are intended to include the plural forms as well, unless the context clearly indicates otherwise.

It will be further understood that the terms "comprise", "include", "have", etc. used in the disclosure, specify the presence of stated features, integers, steps, operations, elements, components, and/or combinations of them but do not preclude the presence or addition of one or more other features, integers, steps, operations, elements, components, and/or combinations thereof.

In addition, when an element is "coupled" to another element, this includes not only the case where the element is directly coupled to the other element, but also the case where another element is coupled between them.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, preferred embodiments of the present invention will be described in detail with reference to the accompanying drawings.

FIG. 1 is a block diagram illustrating a display device according to embodiments of the present invention.

Referring to FIG. 1, a display device 1000 may include a pixel unit 100 (e.g., display panel), a scan driver 200, a data driver 300, and a controller 400.

The display device 1000 may be implemented as a self-light emitting display device including a plurality of self-light emitting elements. For example, the display device 1000 may be an organic light emitting display device including organic light emitting elements or a display device including inorganic light emitting elements. However, this is an example, and the display device 1000 may be implemented as a liquid crystal display device, a quantum dot display device, or the like.

The display device 1000 may be a flat panel display device, a flexible display device, a curved display device, a foldable display device, or a bendable display device. In addition, the display device 1000 may be applied to a transparent display device, a head-mounted display device, a wearable display device, or the like.

The pixel unit 100 may include a plurality of pixels PX connected to scan lines S and data lines D. The display device 1000 according to the present embodiment may be a "single side driving" type display device 1000 in which the data driver 300 and the scan driver 200 are disposed together on the same side of the pixel unit 100. Accordingly, a narrow bezel in which non-display areas on opposite sides of the display device 1000 are minimized may be implemented.

In order to apply the single side driving, each of the scan lines S may include a main scan line SM, a first sub-scan line SS1, and a second sub-scan line SS2.

Figure 3:
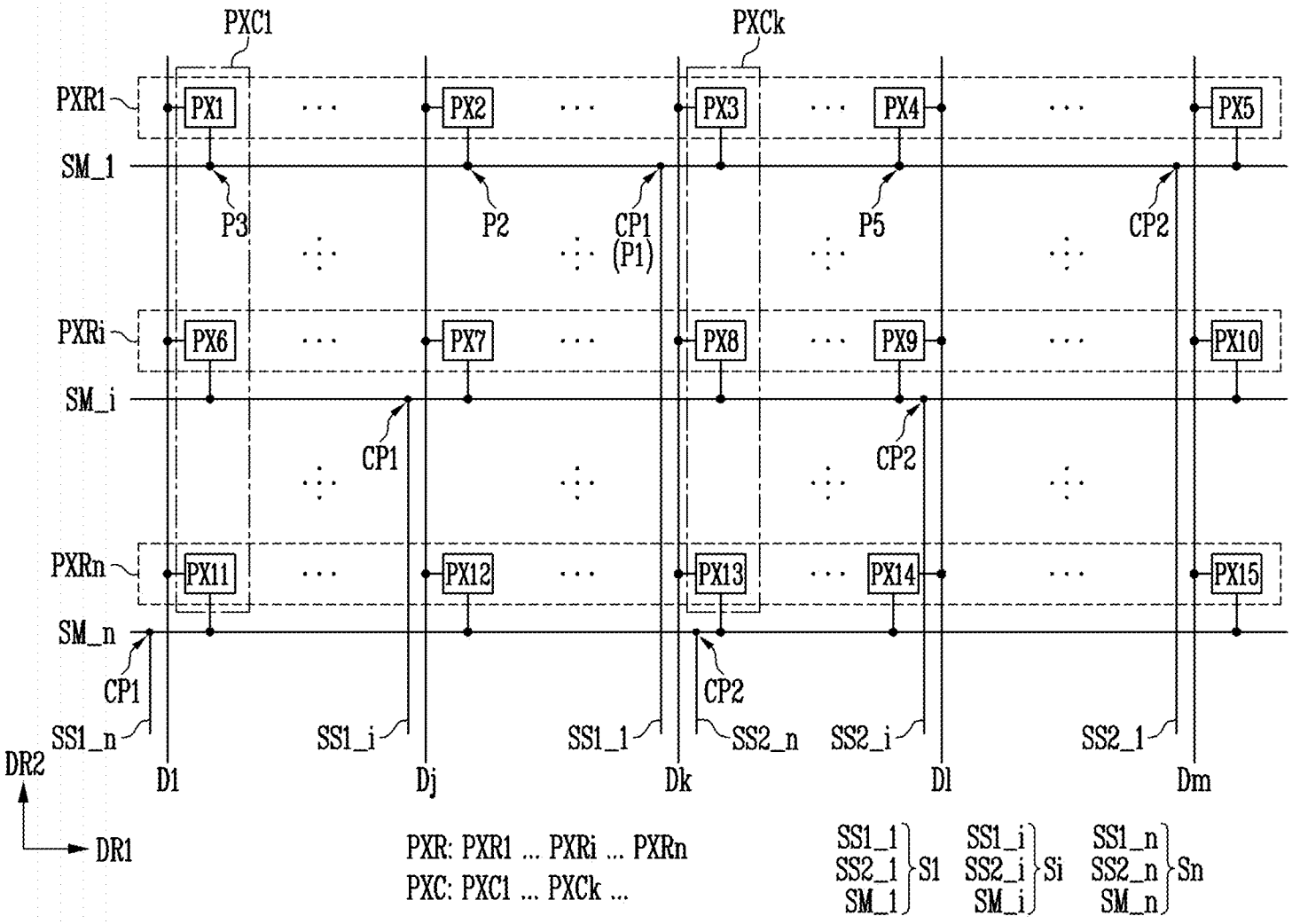
FIG. 3 is a diagram illustrating an example of scan lines and data lines connected to pixel rows and a pixel column included in the display device of FIG. 1.

The main scan line SM may extend in a first direction DR1 and may be connected to the pixels PX in a corresponding pixel row (See PXR in FIG. 3). A scan signal may be supplied to the pixels PX through the main scan line SM. That is, each main scan line SM may define a pixel row.

The first sub-scan line SS1 may extend in a second direction DR2 and may be connected to the main scan line SM at a first contact point CP1. The second sub-scan line SS2 may extend in the second direction DR2 and may be connected to the main scan line SM at a second contact point CP2. In an embodiment, the second direction DR2 may correspond to a direction of a pixel column PXC (See FIG. 3).

The first sub-scan line SS1 and the second sub-scan line SS2 may electrically connect the scan driver 200 and the main scan line SM. When a single sub-scan line is connected to the main scan line SM, a deviation of a resistor-capacitor ("RC") load (i.e., RC delay) between a portion close to a contact point and a portion far from the contact point may increase. In order to reduce the deviation of the RC load, the main scan line SM may be connected to both the first sub-scan line SS1 and the second sub-scan line SS2 spaced apart from the first sub-scan line SS1. That is, the scan signal may be supplied to the main scan line SM through the first contact point CP1 and the second contact point CP2. Therefore, the deviation of the RC load for each position within the main scan line SM may be relatively reduced.

In an embodiment, first sub-scan lines SS1 may be connected to main scan lines SM in a one-to-one manner, and second sub-scan lines SS2 may also be connected to the main scan lines SM in a one-to-one manner. However, the connection relationship between the first and second sub-scan lines SS1 and SS2 and the main scan lines SM according to the invention is not limited thereto. In another embodiment, for example, each of the first sub-scan lines SS1 may be connected to two or more main scan lines SM, and each of the second sub-scan lines SS2 may be connected to two or more main scan lines SM.

As shown in FIG. 1, the first sub-scan lines SS1 and the second sub-scan lines SS2 may be arranged to gradually increase in length in the first direction DR1.

In FIG. 1, each of the scan lines S includes two sub-scan lines, that is, the first sub-scan line SS1 and the second sub-scan line SS2. However, this is an example, and the configuration of the scan lines S according to the invention is not limited thereto. For example, in another embodiment, each of the scan lines S may include three or more sub-scan lines. In this case, the scan signal may be supplied to the main scan line SM through three or more contact points. Therefore, compared to the case where each of the scan lines S includes two sub-scan lines and the scan signal is supplied to the main scan line SM through two contact points, the deviation of the RC load for each position within the main scan line SM may be further reduced. However, when the number of sub-scan lines SS increases, the number of signal wires and input/output terminals may increase. Therefore, the number of sub-scan lines SS included in the scan lines S needs to be set appropriately. For example, each of the scan lines S may include three sub-scan lines. Hereinafter, for convenience of description, a case where each of the scan lines S includes two sub-scan lines, that is, the first sub-scan line SS1 and the second sub-scan line SS2, will be described as an example.

The data lines D may be connected to the pixels PX in units of pixel columns PXC.

The scan driver 200 may receive a first control signal SCS from the controller 400. The scan driver 200 may supply scan signals to the scan lines S in response to the first control signal SCS (in other words, a scan control signal). The first control signal SCS may include a scan start signal, a clock signal, and the like for the scan signal.

The scan signal may be set to a gate-on level (low voltage or high voltage) corresponding to a type (P-type or N-type) of a transistor to which the scan signal is supplied.

The data driver 300 may receive a second control signal DCS (in other words, a data control signal) from the controller 400. The data driver 300 may convert image data RGB in digital form into data signals (e.g., data voltages) in analog form in response to the second control signal DCS, and supply the data signals to the data lines D.

For one pixel row PXR, as described above, the RC load of the scan signal may increase as the distance from the contact point increases along the first direction DR1. In addition, for one pixel column, RC loads of the scan signal and the data signal may increase as the distances from the scan driver 200 and the data driver 300 increase along the second direction DR2.

In an embodiment, output timings of the data signals output from the data driver 300 may be adjusted under the control of the controller 400. For example, the data driver 300 may receive a timing control signal TCS from the controller 400, and adjust the output timing of the data signal output to each data line D in response to the timing control signal TCS.

The controller 400 may receive an input control signal CON and input image data IDATA from an image source such as an external graphic device. The controller 400 may generate the image data RGB suitable for operating conditions of the pixel unit 100 based on the input image data IDATA and provide the image data RGB to the data driver 300.

In an embodiment, the controller 400 may generate the first control signal SCS for controlling the driving timing of the scan driver 200 and the second control signal DCS for controlling the driving timing of the data driver 300 based on the input control signal CON, and provide the first control signal SCS and the second control signal DCS to the scan driver 200 and the data driver 300, respectively.

In addition, the controller 400 may generate the timing control signal TCS for adjusting the output timing of the data signal and provide the timing control signal TCS to the data driver 300.

The controller 400 may adjust the output timing of the data signal in consideration of the deviation of the RC load according to a position of a scan line S to which the scan signal is supplied (for example, a distance from the scan driver 200 in the second direction DR2) and positions of the pixels PX connected to the scan line S (for example, a distance from the contact point in the first direction DR1). Also, the controller 400 may adjust the output timing of the data signal in consideration of the deviation of the RC load according to a position of a data line D to which the data signal is supplied (for example, a distance from the data driver 300 in the second direction DR2).

In an embodiment, the data driver 300 may adjust the output timing of the data signal based on a look-up table LUT (See FIGS. 7-9) included in the timing control signal TCS provided from the controller 400. Here, the look-up table LUT may store delay values of the data signal according to relative positions of the pixels PX in the pixel unit 100. The data driver 300 may adjust the output timing of the data signal based on these delay values.

In an embodiment, the data driver 300 may control the output timing of the data signal by changing a length of a horizontal blank period (in other words, horizontal blank field HBP) based on the timing control signal TCS. This will be described in detail with reference to FIGS. 10 and 11.

Each pixel PX may charge a data voltage corresponding to the data signal. Here, a predetermined time may be required for the data voltage to be charged to a predetermined voltage level, and the data voltage is required to be fully charged within a period in which the scan signal is applied (for example, one horizontal period or two horizontal periods).

However, when the supply timing of the scan signal supplied to each pixel PX and the supply timing of the data signal supplied to each pixel PX are different from each other, a deviation in data charging rate may occur for each pixel PX.

For example, in the wiring structure of the pixel unit 100 as shown in FIG. 1, for one pixel row, the time during which the scan signal is transmitted to the pixels PX in the pixel row may be different by the RC load according to the distance between the first contact point CP1 and the second contact point CP2. In addition, the time during which the scan signal is transmitted to the contact point of each pixel row may be different by the RC load according to the distance from the scan driver 200 to each pixel row. Also, for one pixel column (or one data line D), the time during which the data signal is transmitted to the pixels PX in each pixel row may be different by the RC load according to the distance from the data driver 300 to each pixel row.

Therefore, according to the relative positions of the pixels PX in the pixel unit 100, supply timings of the scan signal and the data signal may not coincide with each other, and the deviation in data charging rate may occur and display quality may deteriorate.

That is, the controller 400 may adaptively control the output timing of the data signal by reflecting the deviation of the RC loads of the scan signal and the data signal according to the relative positions of the pixels PX.

In FIG. 1, the scan driver 200, the data driver 300, and the controller 400 are shown as separate configurations, respectively. However, at least some of the scan driver 200, the data driver 300, and the controller 400 may be integrated into one module or integrated circuit ("IC") chip in another embodiment. In an embodiment, at least some components and/or functions of the controller 400 may be included in the data driver 300. For example, the data driver 300 and the controller 400 may be included in one source IC.

In addition, the scan driver 200 may include a plurality of scan drivers (or scan integrated circuits) each in charge of driving a partial area of the pixel unit 100. Likewise, the data driver 300 may include a plurality of data drivers (or data integrated circuits) each in charge of driving the partial area of the pixel unit 100.

Figure 2:
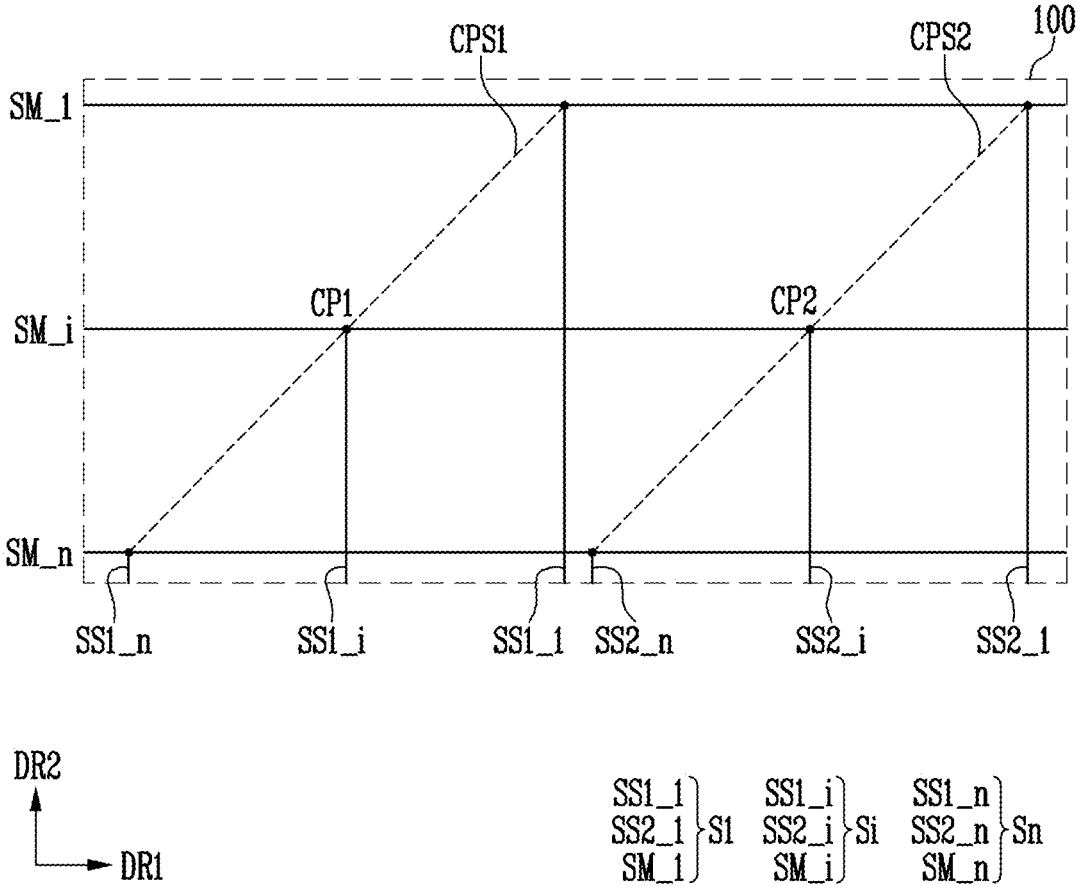
FIG. 2 is a diagram schematically illustrating an example of a pixel unit included in the display device of FIG. 1.

FIG. 2 is a diagram schematically illustrating an example of a pixel unit included in the display device of FIG. 1.

Referring to FIG. 2, scan lines S1 to Sn may include main scan lines SM_1 to SM_n, first sub-scan lines SS1_1 to SS1_*n*, and second sub-scan lines SS2_1 to SS2_*n*, where n may be an integer greater than 1. For example, the scan line S1 may include the main scan line SM_1, the first sub-scan line SS1_1, and the second sub-scan line SS2_1, and the scan line Sn may include the main scan line SM_n, the first sub-scan line SS1_*n*, and the second sub-scan line SS2_*n*.

For example, a first sub-scan line SS1_*i* of an i-th scan line Si may be connected to a main scan line SM_i of the i-th scan line Si through the first contact point CP1, and a second sub-scan line SS2_*i* of the i-th scan line Si may be connected to the main scan line SM_i of the i-th scan line Si through the second contact point CP2, where i may be a natural number equal to or less than n.

In an embodiment, the first sub-scan lines SS1_1 to SS1_*n* and the second sub-scan lines SS2_1 to SS2_*n* may be disposed to gradually increase in length toward the first direction DR1. That is, referring to FIGS. 1 and 2, first pixel row PXR1 which is connected to the first scan line S1 is disposed farthest (i.e., located at the top side of the pixel unit 100) from the data driver 300, and the n-th pixel row PXRn which is connected to the n-th scan line Sn is disposed nearest (i.e., located at the bottom side of the pixel unit 100) from the data driver 300. FIG. 2 schematically shows an arrangement tendency of first contact points CPS1 to which the first sub-scan lines SS1_1 to SS1_*n* are connected and an arrangement tendency of second contact points CPS2 to which the second sub-scan lines SS2_1 to SS2_*n* are connected. For example, a first sub-scan line SS1_1 of a first scan line S1 may be disposed to the right of a first sub-scan line SS1_*n* of an n-th scan line Sn, and a second sub-scan line SS2_1 of the first scan line S1 may be disposed to the right of a second sub-scan line SS2_*n* of the n-th scan line Sn.

According to the arrangement of the first and second contact points CPS1 and CPS2, the RC loads (hereinafter, referred to as loads) of the scan signals supplied to the scan lines S1 to Sn may be different from each other. According to the arrangement of the first and second contact points CPS1 and CPS2, the loads of the scan signals may increase as the distance from a lower side of the pixel unit 100 in the second direction DR2 increases, and the loads of the scan signals may increase as the distances from the first and second contact points CPS1 and CPS2 in the first direction DR1 increase.

As described with reference to FIG. 1, the RC loads of the data signals supplied to the data lines D may increase as the distance from the lower side of the pixel unit 100 in the second direction DR2 increases.

In an embodiment, the scan signals and the data signals may be supplied from an upper side of the pixel unit 100 in a direction opposite to the second direction DR2. For example, the scan signals and the data signals may be sequentially supplied from the pixel row corresponding to a first main scan line SM_1 to the pixel row corresponding to an n-th main scan line SM_n.

FIG. 3 is a diagram illustrating an example of scan lines and data lines connected to pixel rows and a pixel column included in the display device of FIG. 1.

In FIG. 3, a first pixel row PXR1, an i-th pixel row PXRi, an n-th pixel row PXRn, and a k-th pixel column PXCk are shown as an example, where k may be a natural number. In addition, in FIG. 3, scan lines S1, Si, and Sn and data lines D1, Dj, Dk, Dl, and Dm connected to the pixel rows PXR1, PXRi, and PXRn and the pixel column PXCk are shown as an example, where j, l and m may be natural numbers.

Referring to FIG. 3, the first pixel row PXR1 may be connected to the first scan line S1, the i-th pixel row PXRi may be connected to the i-th scan line Si, and the n-th pixel row PXRn may be connected to the n-th scan line Sn.

In an embodiment, the first scan line S1 may include the main scan line SM_1, the first sub-scan line SS1_1, and the second sub-scan line SS2_1. The scan signal supplied to the first and second sub-scan lines SS1_1 and SS2_1 may be supplied to first to fifth pixels PX1 to PX5 of the first pixel row PXR1 through the main scan line SM_1.

The scan signal supplied to the main scan line SM_1 through the first sub-scan line SS1_1 and the scan signal supplied to the main scan line SM_1 through the second sub-scan line SS2_1 may be the same scan signal. Accordingly, the same scan signal may be supplied to the first to fifth pixels PX1 to PX5 of the first pixel row PXR1 through the main scan line SM_1.

The first to fifth pixels PX1 to PX5 may be connected to a first data line D1, a j-th data line Dj, a k-th data line Dk, an l-th data line Dl, and an m-th data line Dm, respectively. When the scan signal is supplied to the first scan line S1, the data signals may be written to the first to fifth pixels PX1 to PX5 through the first, j-th, k-th, l-th, and m-th data lines D1, Dj, Dk, Dl, and Dm, respectively.

The scan signal may be transmitted to the main scan line SM_1 through the first sub-scan line SS1_1, and may be supplied from the first contact point CP1 corresponding to a first position P1 to both directions of the main scan line SM_1. For example, the scan signal may be supplied from the first contact point CP1 to the first direction DR1 (i.e., toward the right in FIG. 3) and a direction opposite (i.e., toward the left in FIG. 3) to the first direction DR1 through the main scan line SM_1. Similarly, the scan signal transmitted through the second sub-scan line SS2_1 may be supplied from the second contact point CP2 to both directions of the main scan line SM_1.

In this case, the load of the scan signal in the main scan line SM_1 and the pixels PX1 to PX5 connected thereto may increase as the distance from the first contact point CP1 increases. For example, the load of the scan signal may be greater at a second position P2 than at the first position P1 corresponding to the first contact point CP1, and the load of the scan signal may be greater at a third position P3 than at the second position P2. In addition, the load of the scan signal may increase as the distance from the second contact point CP2 increases. For example, the load of the scan signal may be greater at a fifth position P5 than at the second contact point CP2. Two contact points (i.e., the first contact point CP1 and the second contact point CP2) may be disposed in the first pixel row PXR1. Therefore, in an area between the first contact point CP1 and the second contact point CP2, the load at the fifth position P5 corresponding to an intermediate point between the first contact point CP1 and the second contact point CP2 may be the largest.

In other words, a waveform of the scan signal supplied to a first pixel PX1 corresponding to the third position P3 may be more affected by the load than a waveform of the scan signal supplied to a second pixel PX2 corresponding to the second position P2 closer to the first contact point CP1 (or first position P1). For example, the scan signal supplied to the first pixel PX1 may be delayed by a relative distance between the second position P2 and the third position P3 compared to the scan signal supplied to the second pixel PX2.

Likewise, a waveform of the scan signal supplied to a fourth pixel PX4 corresponding to the fifth position P5 may be more affected by the load than waveforms of the scan signals supplied to each of a third pixel PX3 and a fifth pixel PX5 close to the first contact point CP1 and the second contact point CP2.

That is, the load of the scan signal may increase toward the left (that is, a direction opposite to the first direction DR1) from the first contact point CP1, and the load of the scan signal may increase toward the fifth position P5 corresponding to the intermediate point from the area between the first contact point CP1 and the second contact point CP2.

Similarly, the i-th scan line S1 may include the main scan line SM_i, the first sub-scan line SS1_*i*, and the second sub-scan line SS2_*i*. The scan signal supplied to the first sub-scan line SS1_*i* and the second sub-scan line SS2_*i* may be supplied to sixth to tenth pixels PX6 to PX10 of the i-th pixel row PXRi through the main scan line SM_i.

In the i-th pixel row PXRi, the load of the scan signal may increase toward the left (that is, the direction opposite to the first direction DR1) from the first contact point CP1, the load of the scan signal may increase toward the right (that is, the first direction DR1) from the second contact point CP2, and the load of the scan signal may increase toward a position corresponding to the intermediate point from the area between the first contact point CP1 and the second contact point CP2.

In addition, the n-th scan line Sn may include the main scan line SM_n, the first sub-scan line SS1_*n*, and the second sub-scan line SS2_*n*. The scan signal supplied to the first sub-scan line SS1_*n* and the second sub-scan line SS2_*n* may be supplied to eleventh to fifteenth pixels PX11 to PX15 of the n-th pixel row PXRn through the main scan line SM_n.

In the n-th pixel row PXRn, the load of the scan signal may increase toward the right (that is, the first direction DR1) from the second contact point CP2, and the load of the scan signal may increase toward the position corresponding to the intermediate point from the area between the first contact point CP1 and the second contact point CP2.

In addition, according to the arrangement tendencies of the first and second contact points CP1 and CP2 described with reference to FIG. 2, the lengths of the first sub-scan lines SS1_1 to SS1_*n* and the second sub-scan lines SS2_1 to SS2_N may increase toward the first direction DR1. Therefore, the load of the scan signal may increase from the n-th scan line Sn toward the first scan line S1. That is, the load of the scan signal may increase as the distance from the scan driver 200 (refer to FIG. 1) to a corresponding pixel row in the second direction DR2 increases.

In an embodiment, for example, in the case of the pixels corresponding to the positions of the first contact point CP1 and the second contact point CP2 of each of the pixel rows PXR1 to PXRn, the distances from the first and second contact points CP1 and CP2 in the first direction DR1 may be the same, but the distances from the scan driver 200 (refer to FIG. 1) to the pixel rows PXR1 to PXRn may be different. Therefore, the load of the scan signal may be different. For example, the load of the scan signal supplied to the pixels corresponding to the positions of the first and second contact points CP1 and CP2 in the i-th pixel row PXRi may be larger than the load of the scan signal supplied to the pixels corresponding to the positions of the first and second contact points CP1 and CP2 in the n-th pixel row PXRn. Similarly, the load of the scan signal supplied to the pixels corresponding to the positions of the first and second contact points CP1 and CP2 in the first pixel row PXR1 may be larger than the load of the scan signal supplied to the pixels corresponding to the positions of the first and second contact points CP1 and CP2 in the i-th pixel row PXRi.

The k-th pixel column PXCk may be connected to the k-th data line Dk. The data signal supplied to the k-th data line Dk may be supplied to third, eighth, and thirteenth pixels PX3, PX8, and PX13 of the k-th pixel column PXCk.

In this case, in the k-th data line Dk and the pixels PX3, PX8, and PX13 connected thereto, the load of the data signal may increase as the distance in the second direction DR2 increases. For example, as the distance from the data driver 300 (refer to FIG. 1) in the second direction DR2 increases, the load of data signal supplied to the pixels PX3, PX8, and PX13 may increase. For example, the load of the data signal supplied to the eighth pixel PX8 may be larger than the load of the data signal supplied to the thirteenth pixel PX13, and the load of the data signal supplied to the third pixel PX3 may be larger than the load of the data signal supplied to the eighth pixel PX8.

FIGS. 4A, 4B, 4C and 5 may be referred to in order to more specifically describe the deviation of the loads of the scan signal and the data signal according to the relative positions of the pixels in the first direction DR1 and the second direction DR2.

Figure 4A:
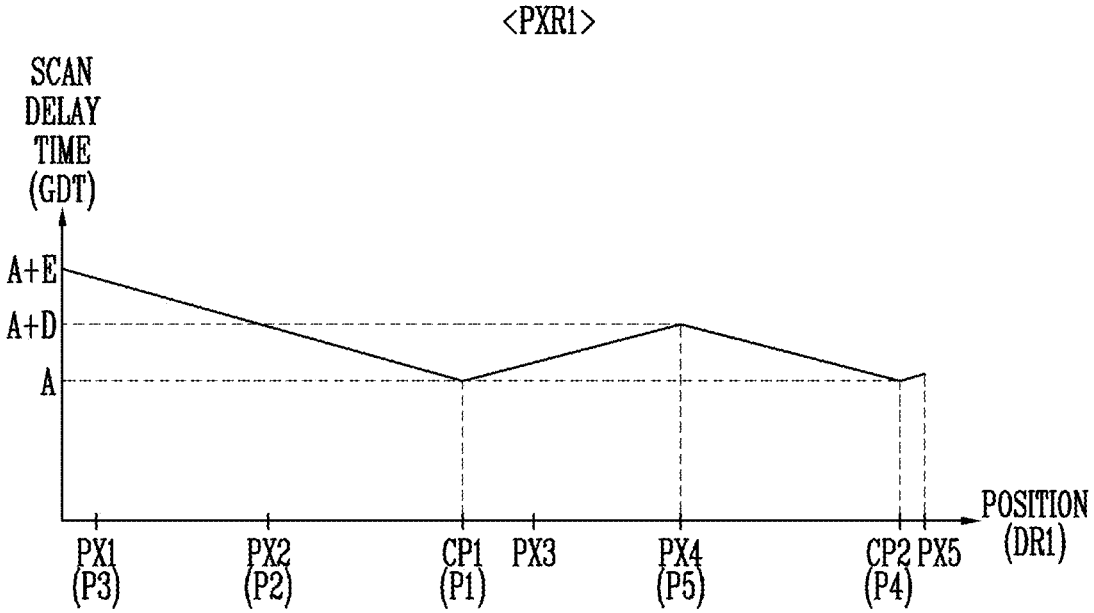
FIGS. 4A to 4C are graphs illustrating examples of a supply delay time of a scan signal supplied to each of the pixel rows of FIG. 3.
Figure 4B:
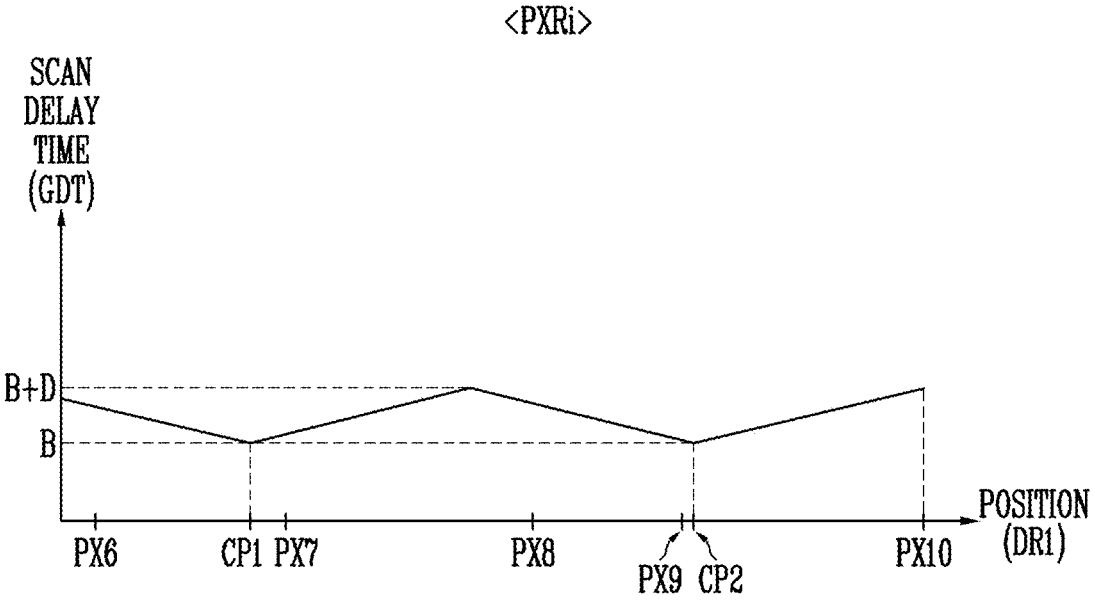
Figure 4C:
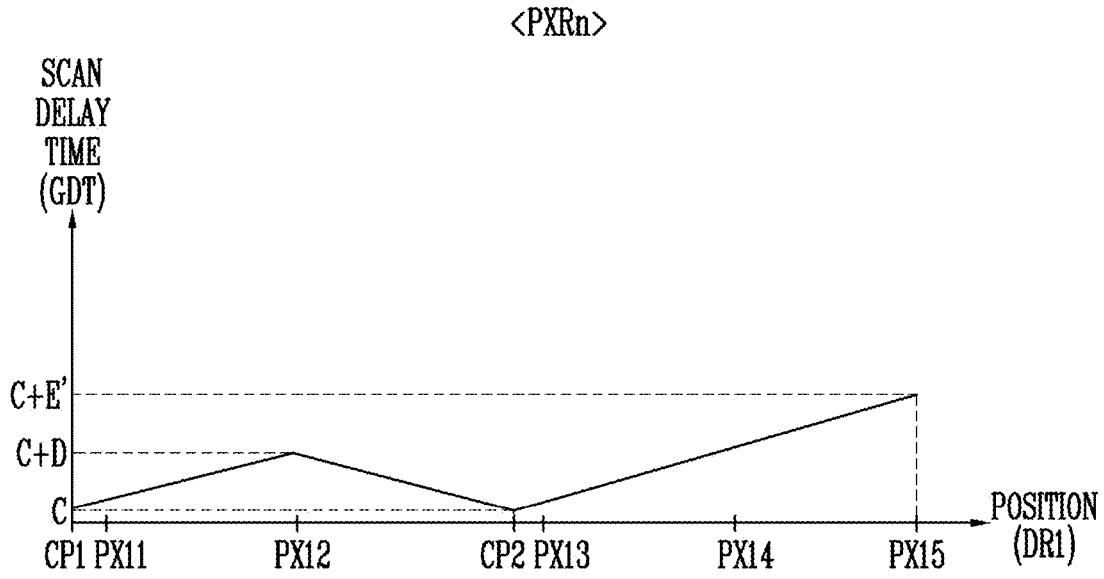
Figure 5:
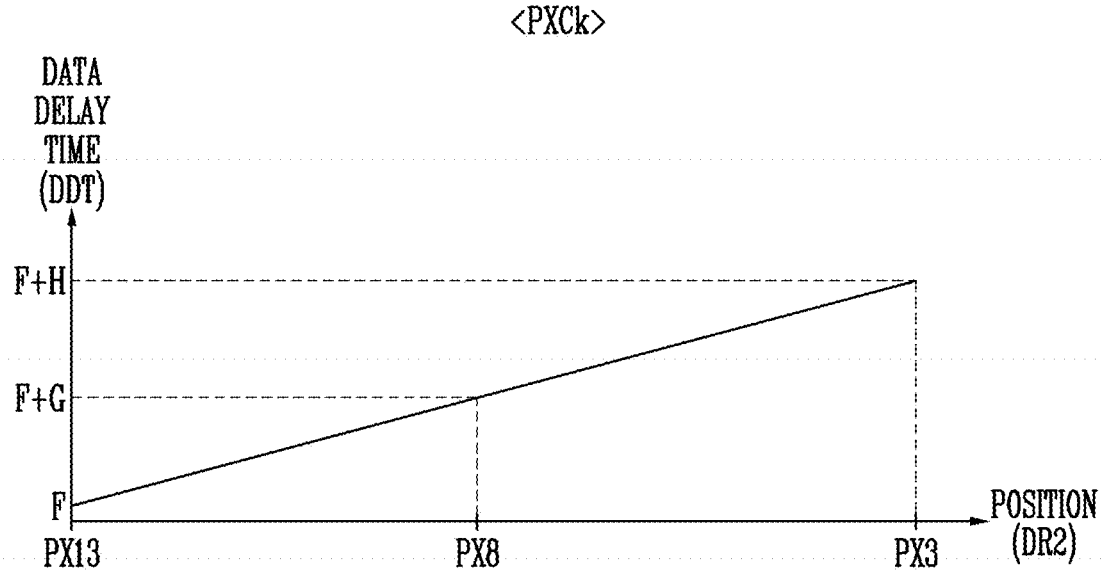
FIG. 5 is a graph illustrating an example of a supply delay time of a data signal supplied to the pixel column of FIG. 3.

FIGS. 4A to 4C are graphs illustrating examples of a supply delay time of a scan signal supplied to each of the pixel rows of FIG. 3. FIG. 5 is a graph illustrating an example of a supply delay time of a data signal supplied to the pixel column of FIG. 3.

Referring to FIG. 4A, FIG. 4A shows a delay time GDT of the scan signal according to a relative position POSITION of the first pixel row PXR1 in the first direction DR1.

As described with reference to FIG. 3, in the first pixel row PXR1, since the load of the scan signal is the least at the first contact point CP1 and the second contact point CP2 corresponding to the first position P1, the delay time GDT (i.e., A of the scan signal) may be the shortest at the first and second contact points CP1 and CP2. In addition, since the load of the scan signal increases as the distances from the first and second contact points CP1 and CP2 in the first direction DR1 increase, the delay time GDT of the scan signal may increase as the distance from the first position P1 corresponding to the first contact point CP1 increases, and the delay time GDT (i.e., A+E of the scan signal) may be longest at a point where the distance from the first position P1 is the farthest. In the area between the first contact point CP1 and the second contact point CP2, the delay time GDT (i.e., A+D of the scan signal) may be longest at the fifth position P5 corresponding to the intermediate point between the first contact point CP1 and the second contact point CP2.

Referring to FIG. 4B, FIG. 4B shows the delay time GDT of the scan signal according to the relative position POSITION of the i-th pixel row PXRi in the first direction DR1.

Similar to that described in FIG. 4A, in the i-th pixel row PXRi, the delay time GDT (i.e., B of the scan signal) may be the shortest at the first and second contact points CP1 and CP2, and the delay time GDT of the scan signal may increase as the distances from the first and second contact points CP1 and CP2 in the first direction DR1 increase. In the area between the first contact point CP1 and the second contact point CP2, the delay time GDT (i.e., B+D of the scan signal) may be longest at the position corresponding to the intermediate point between the first contact point CP1 and the second contact point CP2.

Referring to FIG. 4C, FIG. 4C shows the delay time GDT of the scan signal according to the relative position POSITION of the n-th pixel row PXRn in the first direction DR1.

Similar to that described in FIG. 4A, in the n-th pixel row PXRn, the delay time GDT (i.e., C of the scan signal) may be the shortest at the first and second contact points CP1 and CP2, and the delay time GDT of the scan signal may increase as the distances from the first and second contact points CP1 and CP2 in the first direction DR1 increase. In the n-th pixel row PXRn, the delay time GDT (i.e., C+E' of the scan signal) may be longest at a position (for example, a position corresponding to the fifteenth pixel PX15) where the distances from the first and second contact points CP1 and CP2 are the farthest in the first direction DR1. In the area between the first contact point CP1 and the second contact point CP2, the delay time GDT (i.e., C+D of the scan signal) may be longest at the position corresponding to the intermediate point between the first contact point CP1 and the second contact point CP2.

In addition, as described with reference to FIGS. 1 and 3, as the distance from the scan driver 200 to the pixel row PXR increases in the second direction DR2, the load of the scan signal may increase. For example, when comparing the delay time GDT of the scan signal at the first and second contact points CP1 and CP2 of each pixel row, the delay time A of the scan signal may be the longest at the first and second contact points CP1 and CP2 of the first pixel row PXR1, which is the farthest from the scan driver 200 in the second direction DR2, and the delay time C of the scan signal may be the shortest at the first and second contact points CP1 and CP2 of the n-th pixel row PXRn, which is the closest to the scan driver 200 in the second direction DR2. That is, the delay time GDT may be A>B>C.

Referring to FIG. 5, FIG. 5 shows the delay time DDT of the data signal according to the relative position POSITION of the k-th pixel column PXCk in the second direction DR2.

As described with reference to FIGS. 1 and 3, in the k-th pixel column PXCk, since the load of the data signal increases as the distance from the data driver 300 in the second direction DR2 increases, the delay time DDT (i.e., F of the data signal) may be the shortest at a position corresponding to the thirteenth pixel PX13, and the delay time DDT (i.e., F+H of the data signal) may be the longest at a position corresponding to the third pixel PX3. That is, the delay time DDT may be F+H>F+G>F.

Figure 6:
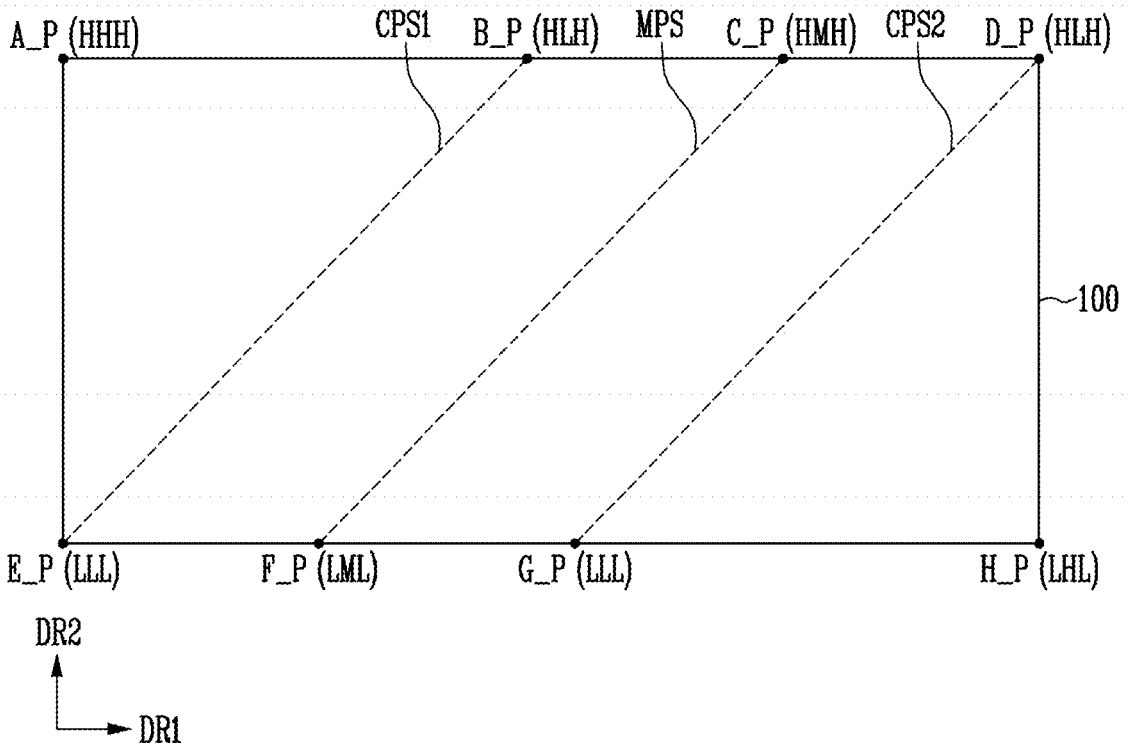
FIG. 6 is a diagram for explaining a load of a scan signal and a load of a data signal according to relative positions of pixels in the pixel unit of FIG. 2.
Figure 7:
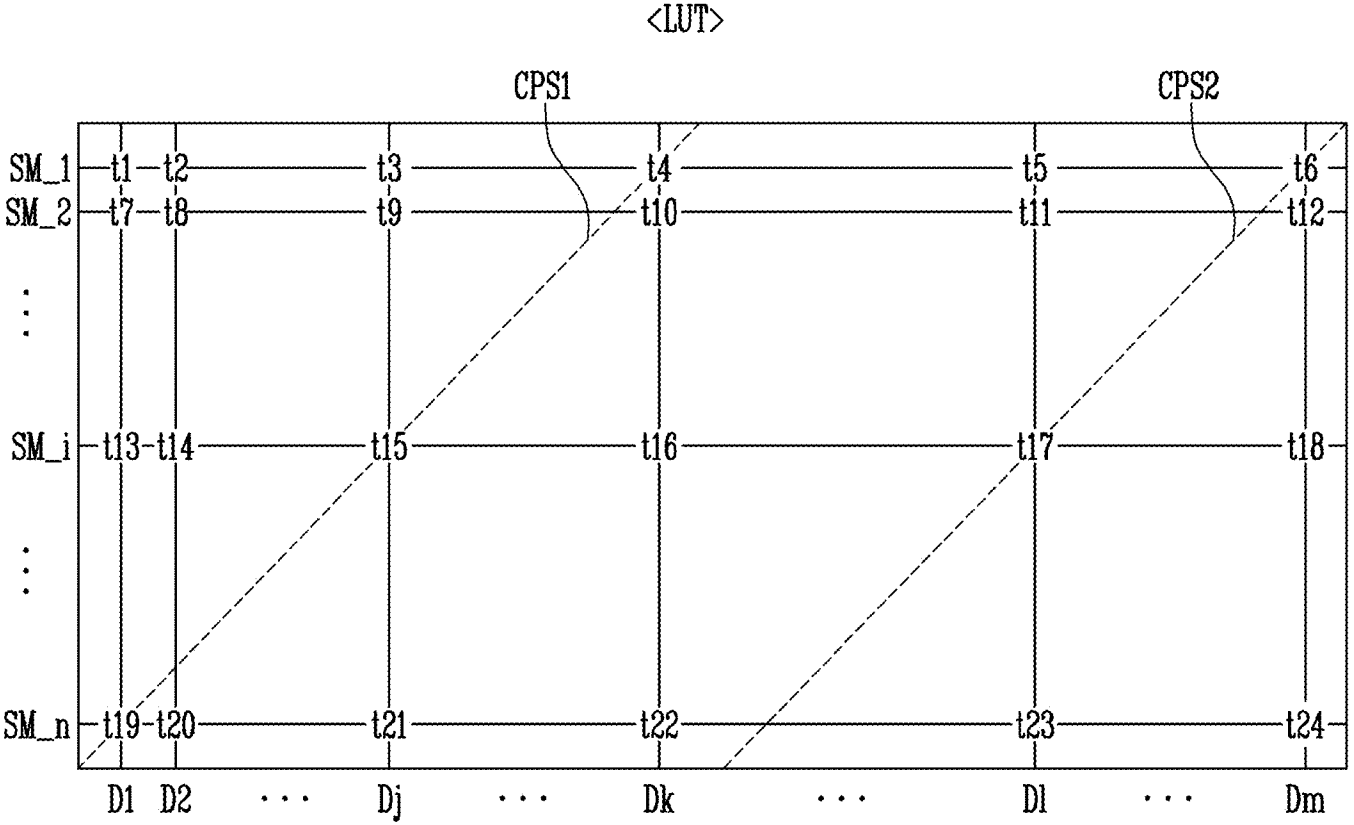
FIGS. 7 to 9 are diagrams for explaining examples of a look-up table provided to a data driver from a controller of FIG. 1.
Figure 8:
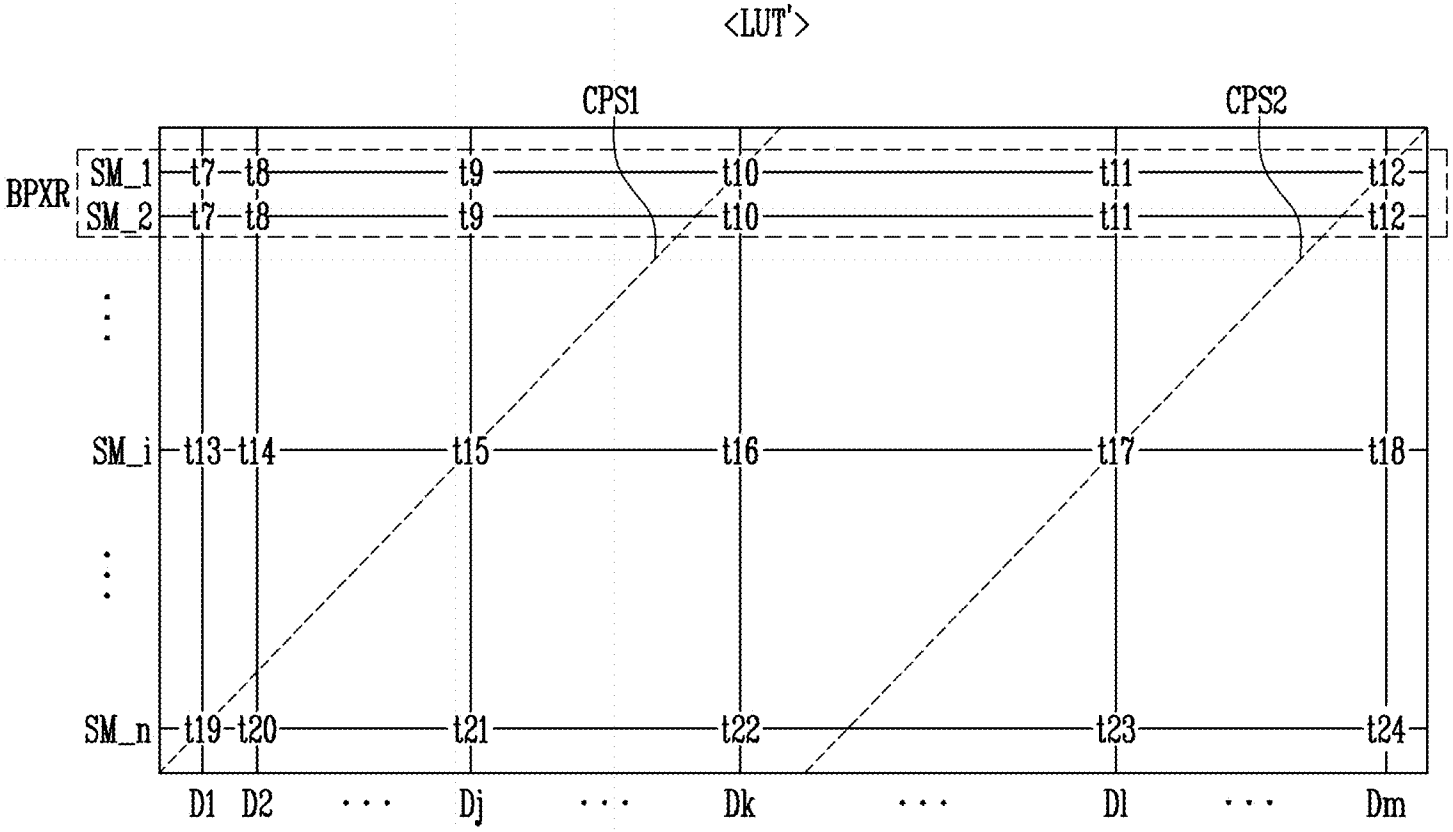
Figure 9:
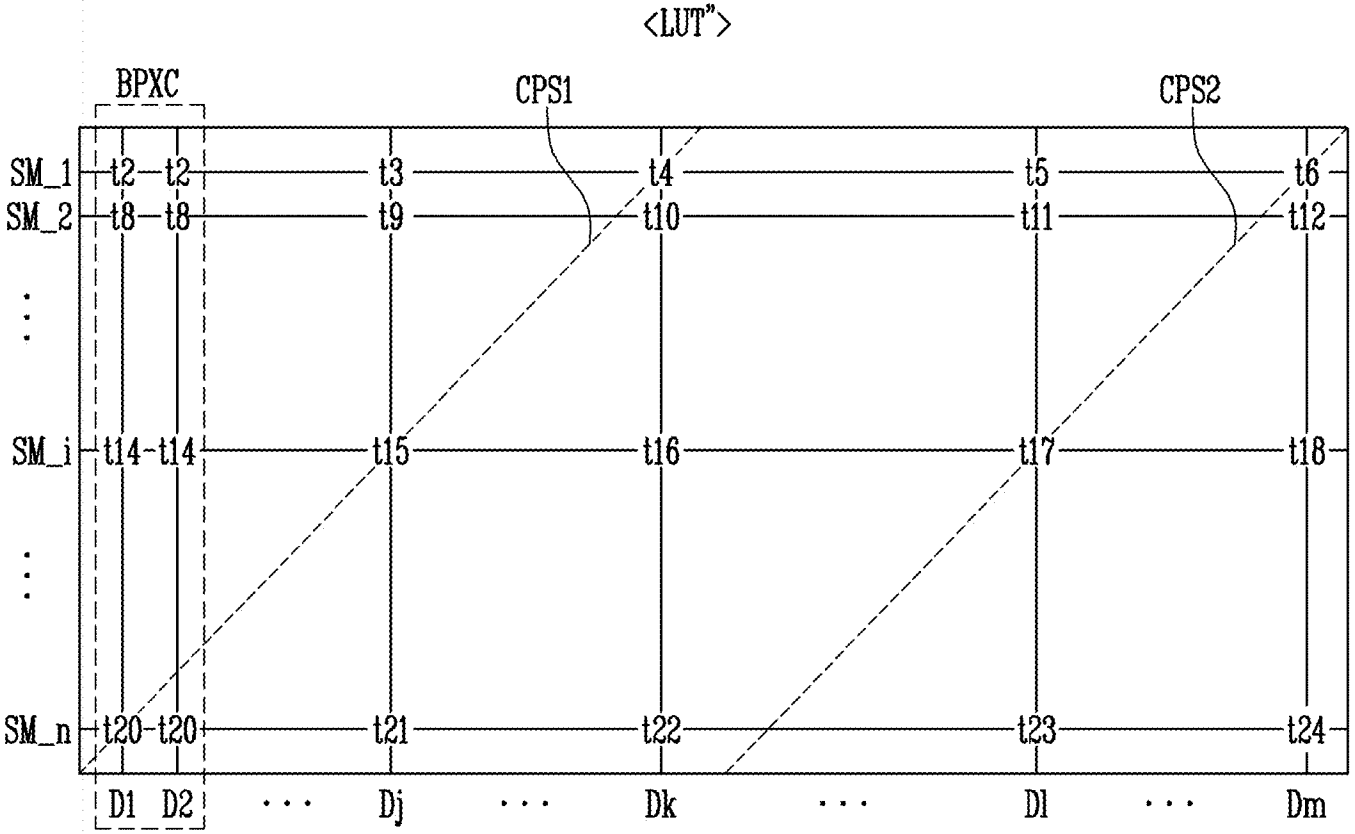

FIG. 6 is a diagram for explaining a load of a scan signal and a load of a data signal according to relative positions of pixels in the pixel unit of FIG. 2. FIGS. 7 to 9 are diagrams for explaining examples of a look-up table provided to a data driver from a controller of FIG. 1.

Referring to FIGS. 1, 3 and 6, the controller 400 may control the output timing of the data signal based on the loads of the scan signal and the data signal according to the relative positions of the pixels PX in the pixel unit 100.

In an embodiment, the controller 400 may generate the timing control signal TCS for controlling the output timing of the data signal of the data driver 300 based on the load of the scan signal (hereinafter, referred to as a "scan load") and the load of the data signal (hereinafter, referred to as a "data load") according to the relative positions in the pixel unit 100 previously stored. For example, as shown in FIG. 6, the scan load and the data load of the points A to H (i.e., A_P to H_P) may be previously stored in the controller 400.

Here, the data load may be largest at the point A (A_P), the point B (B_P), the point C (C_P), and the point D (D_P), and the data load may be smallest at the point E (E_P), the point F (F_P), the point G (G_P), and the point H (H_P). That is, the data load may be the largest at a point where the distance from the data driver 300 is the farthest in the second direction DR2, and the data load may be the smallest at a point, which is the closest to the data driver 300 in the second direction DR2.

In addition, here, the scan load corresponding to the distance from the scan driver 200 in the second direction DR2 may be the largest at the point A (A_P), the point B (B_P), the point C (C_P), and the point D (D_P), and the scan load corresponding to the distance from the scan driver 200 in the second direction DR2 may be the smallest at the point E (E_P), the point F (F_P), the point G (G_P), and the point H (H_P).

In addition, the closer to the first contact points CPS1 or the second contact points CPS2, the smaller the scan load may be, and the farther away from the first contact points CPS1 or the second contact points CPS2, the larger the scan load may be. Also, in areas between the first contact points CPS1 and the second contact points CPS2, the closer to intermediate points MPS, the larger the scan load may be. For example, the scan load corresponding to the distances from the first and second contact points CPS1 and CPS2 in the first direction DR1 may be the smallest at the point B (B_P), the point D (D_P), the point E (E_P), and the point G (G_P). The scan load corresponding to the distances from the first and second contact points CPS1 and CPS2 in the first direction DR1 may be largest at the point A (A_P) and the point H (H_P). In addition, in the areas between the first contact points CPS1 and the second contact points CPS2, the scan load corresponding to the distances from the first and second contact points CPS1 and CPS2 in the first direction DR1 may be the largest at the point C (C_P) and the point F (F_P).

As described above, for each of the points (A_P, B_P, C_P, D_P, E_P, F_P, G_P, and H_P), one of a first load HHH, a second load HMH, a third load HLH, a fourth load LHL, a fifth load LML, and a sixth load LLL may be set according to the scan load (or a sum of the scan load corresponding to the distance from the scan driver 200 in the second direction DR2 and the scan load corresponding to the distances from the first and second contact points CPS1 and CPS2 in the first direction DR1) and the data load.

The first load HHH may mean a load in which all of the scan load corresponding to the distance from the scan driver 200 in the second direction DR2, the scan load corresponding to the distances from the first and second contact points CPS1 and CPS2 in the first direction DR1, and the data load are maximum.

The second load HMH may mean a load in which the scan load and the data load corresponding to the distance from the scan driver 200 in the second direction DR2 are maximum and the scan load corresponding to the distances from the first and second contact points CPS1 and CPS2 in the first direction DR1 is intermediate.

The third load HLH may mean a load in which the scan load and the data load corresponding to the distance from the scan driver 200 in the second direction DR2 are maximum, and the scan load corresponding to the distances from the first and second contact points CPS1 and CPS2 in the first direction DR1 is minimum.

The fourth load LHL may mean a load in which the scan load and the data load corresponding to the distance from the scan driver 200 in the second direction DR2 are minimum, and the scan load corresponding to the distances from the first and second contact points CPS1 and CPS2 in the first direction DR1 is maximum.

The fifth load LML may mean a load in which the scan load and the data load corresponding to the distance from the scan driver 200 in the second direction DR2 are minimum, and the scan load corresponding to the distances from the first and second contact points CPS1 and CPS2 in the first direction DR1 is intermediate.

The sixth load LLL may mean a load in which all of the scan load corresponding to the distance from the scan driver 200 in the second direction DR2, the scan load corresponding to the distances from the first and second contact points CPS1 and CPS2 in the first direction DR1, and the data load are minimum.

Here, the scan load (hereinafter, referred to as a "final scan load") may be determined as a sum of the scan load corresponding to the distance from the scan driver 200 in the second direction DR2 and the scan load corresponding to the distances from the first and second contact points CPS1 and CPS2 in the first direction DR1.

In this case, delays of the scan signal and the data signal supplied to a target pixel according to the final scan load and the data load may be different from each other. Accordingly, the supply timings of the scan signal and the data signal may or may not coincide with each other.

In an embodiment, when the supply timings of the scan signal and the data signal supplied to the target pixel according to the final scan load and the data load coincide with each other, the controller 400 may control the data driver 300 so that the data signal is not substantially delayed and output.

In an embodiment, when the supply timings of the scan signal and the data signal supplied to the target pixel according to the final scan load and the data load do not coincide with each other, the controller 400 may control the data driver 300 so that the data signal is delayed and output.

In another embodiment, for example, when the supply timing of the data signal is later than the supply timing of the scan signal, the controller 400 may control the data driver 300 so that the data signal is output in accordance with the supply timing of the scan signal by delaying the data signal by a predetermined delay value. For example, the controller 400 may delay the data signal by a negative (−) delay value to accelerate the supply timing of the data signal. As used herein, "delay a signal by a negative (−) value" has the same meaning with "provide the signal early by a positive (+) value".

As another example, when the supply timing of the data signal is earlier than the supply timing of the scan signal, the controller 400 may control the data driver 300 so that the data signal is output in accordance with the supply timing of the scan signal by delaying the data signal by the predetermined delay value. For example, the controller 400 may delay the data signal by a positive (+) delay value to delay the supply timing of the data signal.

Specifically, each of the points A_P to H_P in the pixel unit 100 shown in FIG. 6 will be described as an example. At the points E and G (E_P and G_P), both the final scan load and the data load may be minimum (shown as LLL). In this case, the scan signal and the data signal supplied to the pixels PX corresponding to the points E and G (E_P and G_P) may not be substantially delayed. In other words, the supply timings of the scan signal and the data signal supplied to the pixels PX corresponding to the points E and G (E_P and G_P) may coincide with each other. For example, the supply timings of the scan signal and the data signal supplied to the eleventh pixel PX11 and the thirteenth pixel PX13 of FIG. 3 may coincide with each other. In this case, the controller 400 may control the data driver 300 so that the data signal is not substantially delayed and output.

In addition, at the points F and H (F_P and H_P), the data load may be minimum, but the scan load corresponding to the distances from the first and second contact points CPS1 and CPS2 in the first direction DR1 may be an intermediate load or a maximum load (shown as LML and LHL). In this case, the scan signal supplied to the pixels PX corresponding to the points F and H (F_P and H_P) may be delayed according to the final scan load. That is, at the points F and H (F_P and H_P), the supply timings of the scan signal and the data signal supplied to the pixels PX may not coincide with each other according to the final scan load and data load. For example, the supply timings of the scan signal and the data signal supplied to the twelfth pixel PX12 and the fifteenth pixel PX15 of FIG. 3 may not coincide with each other. Specifically, since the supply timing of the scan signal is delayed corresponding to the final scan load at the points F and H (F_P and H_P), the supply timing of the scan signal may be slower than the supply timing of the data signal. In this case, the controller 400 may control the data driver 300 so that the data signal is output in accordance with the supply timing of the scan signal by delaying the data signal by the positive (+) delay value to delay the supply timing of the data signal.

In addition, at the points B and D (B_P and D_P), the scan load corresponding to the distances from the first and second contact points CPS1 and CPS2 in the first direction DR1 may be minimum, but the data load and the scan load corresponding to the distance from the scan driver 200 in the second direction DR2 may be maximum (shown as HLH). In this case, the scan signal and the data signal supplied to the pixels PX corresponding to the points F and H (F_P and H_P) may be delayed according to the final scan load and data load. Here, assuming that the supply timing of the data signal supplied to the points F and H (F_P and H_P) is slower than the supply timing of the scan signal according to the final scan load and the data load, in this case, the controller 400 may control the data driver 300 so that the data signal is output in accordance with the supply timing of the scan signal by delaying the data signal by the negative (−) delay value to accelerate the supply timing of the data signal. Alternatively, assuming that the supply timing of the data signal supplied to the points F and H (F_P and H_P) is earlier than the supply timing of the scan signal according to the final scan load and the data load, in this case, the controller 400 may control the data driver 300 so that the data signal is output in accordance with the supply timing of the scan signal by delaying the data signal by the positive (+) delay value to delay the supply timing of the data signal. The supply timings of the scan signal and the data signal may vary according to design items such as the size and area of the pixel unit 100.

In addition, similarly for the points A and D (A_P and D_P), in response to the supply timings of the scan signal and the data signal according to the final scan load and data load, the controller 400 may control the data driver 300 so that the supply timing of the data signal and the supply timing of the scan signal coincide with each other.

In an embodiment, the data driver 300 may adjust the output timing of the data signal based on the look-up table LUT included in the timing control signal TCS provided from the controller 400. Here, the look-up table LUT may store the delay values of the data signals according to the relative positions of the pixels PX within the pixel unit 100. The delay values of the data signals may be determined so that the supply timing of the scan signal and the supply timing of the data signal coincide with each other according to the scan load and the data load according to the relative positions of the pixels PX. The data driver 300 may adjust the output timings of the data signals based on such delay values.

For example, as shown in FIG. 7, the look-up table LUT may store delay values t1 to t24 of the data signals for each position corresponding to each pixel PX of the pixel unit 100. Based on the look-up table LUT, the data driver 300 may control the supply timings of the data signals for each position corresponding to each pixel PX.

In an embodiment, the controller 400 may control the output timing of the data signal in units of pixel row blocks.

For example, the controller 400 may set adjacent pixel rows among the pixel rows (or adjacent main scan lines among the main scan lines SM_1 to SM_n) as pixel row blocks BPXR, and control the output timing of the data signal output to one data line for each pixel row PXR in units of the pixel row blocks BPXR. For example, in FIG. 8, two adjacent pixel rows PXR are included in one pixel row block BPXR. In this case, as shown in FIG. 8, a look-up table LUT' may store delay values t7 to t24 of the data signals in units of the pixel row blocks BPXR for one data line. For example, for a first pixel column PXC1, the controller 400 may control the output timing of the data signal output to the first data line D1 in units of the pixel row blocks BPXR. In this case, a delay value t7 of the same data signal may be stored in the look-up table LUT' corresponding to the first data line D1 and main scan lines SM_1 and SM_2 included in the same pixel row block BPXR. Similarly, for each of pixel columns PXC, the controller 400 may control the output timing of the data signal output to each of the second, j-th, k-th, l-th, and m-th data lines D2, Dj, Dk, Dl, and Dm in units of the pixel row blocks BPXR. In this case, each of delay values t8, t9, t10, t11, and t12 of the same data signal may be stored in the look-up table LUT' corresponding to each of the second, j-th, k-th, l-th, and m-th data lines D2, Dj, Dk, Dl, and Dm and the main scan lines SM_1 and SM_2 included in the same pixel row block BPXR.

FIG. 8 shows a case in which two adjacent pixel rows among the pixel rows PXR are set as the pixel row blocks BPXR, but this is only an example, and three or more adjacent pixel rows among the pixel rows PXR may be set as the pixel row blocks BPXR.

In an embodiment, the controller 400 may control the output timing of the data signal in units of pixel column blocks.

For example, the controller 400 may set adjacent pixel columns among the pixel columns PXC (or adjacent data lines among the data lines D1 to Dm) as pixel column blocks BPXC, and control the output timings of the data signals output to the data lines D1 to Dm in units of the pixel column blocks BPXC. In this case, as shown in FIG. 9, a look-up table LUT" may store delay values t2 to t6, t8 to t12, t14 to t18, and t20 to t24 of the data signals in units of the pixel column blocks BPXC. For example, for the first pixel row PXR1 corresponding to the main scan line SM_1, the controller 400 may control the output timings of the data signals output to the first and second data lines D1 and D2 in units of the pixel column blocks BPXC. In this case, a delay value t2 of the same data signal may be stored in the look-up table LUT" corresponding to the first and second data lines D1 and D2 included in the same pixel column block BPXR as the first pixel row PXR1 (or the main scan line SM_1). Similarly, for each of the pixel rows, the controller 400 may control the output timings of the data signals output to the first and second data lines D1 and D2 corresponding to each of the main scan lines SM_2, SM_i, and SMn in units of the pixel column blocks BPXC. In this case, each of the delay values t8, t14, and t20 of the same data signal may be stored in the look-up table LUT" corresponding to each of the main scan lines SM_2, SM_i, and SMn and the first and second data lines D1 and D2 corresponding to the same pixel column block BPXC.

FIG. 9 shows a case in which two adjacent pixel columns among the pixel columns PXC are set as the pixel column blocks BPXC, but this is only an example, and three or more adjacent pixel columns among the pixel columns PXC may be set as the pixel column blocks BPXC.

In this way, the controller 400 and the data driver 300 may control the output timings of the data signals output to the data lines D in units of the pixel row blocks BPXR and/or in units of the pixel column blocks BPXC. Therefore, the driving burden and power consumption of the controller 400 and the data driver 300 may be reduced.

As described above, in the display device 1000 according to the embodiments of the present invention, the output timings (i.e., output delay time) of the data signals may be controlled differently according to the positions of the pixels in the pixel unit 100 in consideration of the scan load and the data load in the single side driving method. Accordingly, the deviation in charging rate of the data signal of the pixels PX may be reduced, and the display quality may be improved.

Figure 10:
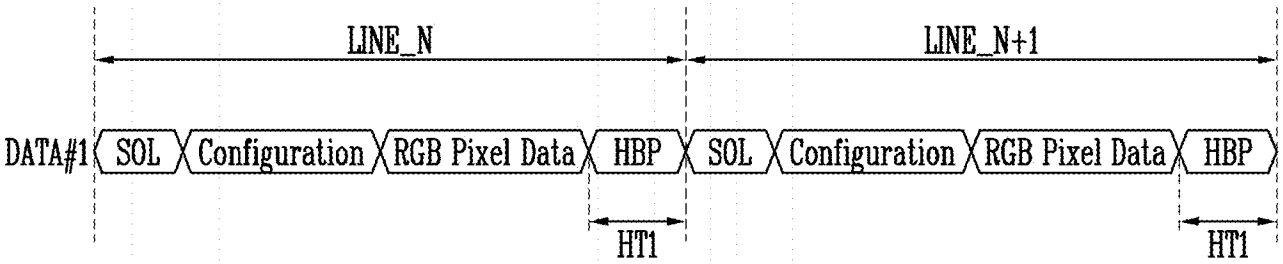
FIGS. 10 and 11 are diagrams for explaining an operation of the controller and the data driver controlling an output timing of the data signal.
Figure 11:
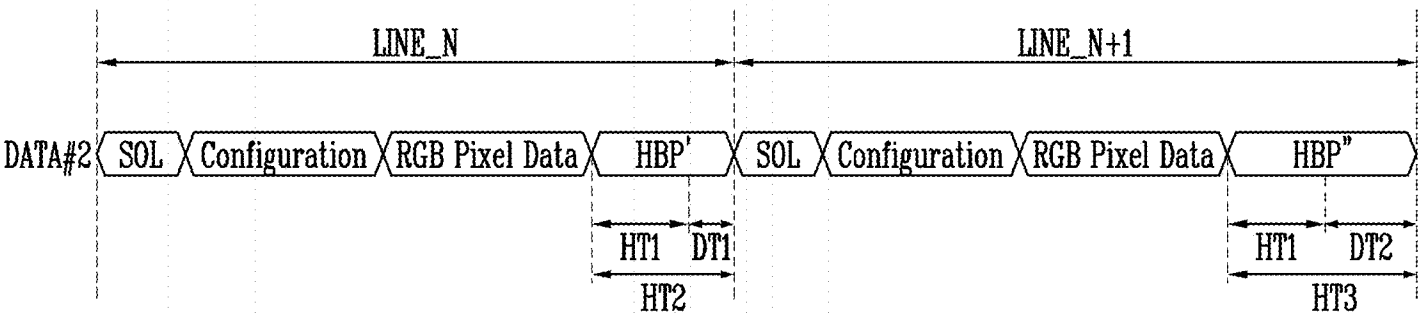

FIGS. 10 and 11 are diagrams for explaining an operation of the controller and the data driver controlling an output timing of the data signal. FIGS. 10 and 11 show examples of data packages DATA #1 and DATA #2 transmitted from the controller to the data driver.

Each of the data packages DATA #1 and DATA #2 may be a data package transmitted to the data driver 300 corresponding to one pixel column (i.e., one data line), or a data package transmitted to the data driver 300 corresponding to the data lines included in the same pixel column block BPXC as described with reference to FIG. 9. Hereinafter, a case in which each of the data packages DATA #1 and DATA #2 is the data package transmitted to the data driver 300 corresponding to one pixel column (i.e., one data line) will be described as an example. That is, hereinafter, a case where the controller 400 controls the output timing of the data signal in units of pixel columns PXC will be described as an example.

In addition, hereinafter, a case where the controller 400 controls the output timing of the data signal in units of pixel rows will be described as an example.

Referring to FIGS. 1 to 3, 10, and 11, each of the data packages DATA #1 and DATA #2 may include a line start field SOL, a configuration field Configuration, a pixel data field RGB Pixel Data, and a horizontal blank field HBP.

The line start field SOL may indicate the start of each line (each pixel row PXR) of an image frame displayed on the pixel unit 100. The data driver 300 may divide the configuration field Configuration and the pixel data field RGB Pixel Data based on a counting result of a counter by operating an internal counter in response to the line start field SOL.

The configuration field Configuration may include configuration data for controlling the data driver 300. The configuration data may include frame configuration data for controlling the frame setting of the image frame or line configuration data for controlling the setting of each line. Also, the configuration data may include a frame synchronization signal that is activated when an image data RGB for the last line of the image frame is transmitted. The data driver 300 may recognize that a vertical blank period starts after the current image data RGB is received by receiving the activated frame synchronization signal. In addition, the configuration data may include various types of control data.

In an embodiment, the configuration data may include the timing control signal TCS described with reference to FIG. 1. The data driver 300 may control the output timing of the data signal by changing the length of the horizontal blank field HBP based on the timing control signal TCS included in the configuration data.

The pixel data field RGB Pixel Data may include pixel data.

The horizontal blank field HBP may be a section allocated to secure a time for the data driver 300 to drive the pixel unit 100 based on the pixel data.

As described above, according to the scan load and data load according to the relative positions of the pixels PX in the pixel unit 100, when the supply timings of the scan signal and the data signal coincide with each other, the controller 400 may control the data driver 300 so that the data signal is not substantially delayed and output. For example, as shown in FIG. 10, the horizontal blank field HBP corresponding to each of adjacent lines LINE_N and LINE_N+1 (or pixel rows PXR) may have a first length HT1. That is, the data driver 300 may read data in the horizontal blank field HBP corresponding to the first length HT1 for each of the lines LINE_N and LINE_N+1 based on the timing control signal TCS included in the configuration field Configuration.

On the other hand, according to the scan load and the data load according to the relative positions of the pixels PX in the pixel unit 100, when the supply timings of the scan signal and the data signal do not coincide with each other, the controller 400 may control the data driver 300 so that the supply timing of the data signal and the supply timing of the scan signal coincide with each other by delaying the data signal by the predetermined delay value. For example, as shown in FIG. 11, a horizontal blank field HBP' corresponding to a first line LINE_N may have a second length HT2 that is longer than the first length HT1 by a first delay length DT1, and a horizontal blank field HBP" corresponding to a second line LINE_N+1 may have a third length HT3 that is longer than the first length HT1 by a second delay length DT2. That is, the data driver 300 may read data in the horizontal blank fields HBP' and HBP" corresponding to the second length HT2 and the third length HT3 for each of the lines LINE_N and LINE_N+1 based on the timing control signal TCS included in the configuration field Configuration.

In this case, as the length of the horizontal blank field HBP' corresponding to the first line LINE_N is changed, the output timing of the data signal of the second line LINE_N+1 corresponding to the next adjacent line may be delayed by the first delay length DT1. Similarly, as the length of the horizontal blank field HBP" corresponding to the second line LINE_N+1 is changed, the output timing of the data signal of the next adjacent line may be delayed by the second delay length DT2.

In this way, the data driver 300 may control the output timing of the data signal corresponding to an adjacent corresponding line (current pixel row) by changing the length of the horizontal blank field HBP corresponding to a previous line (previous pixel row) of a corresponding line (current pixel row) and reading, in response to the timing control signal TCS included in the configuration field Configuration in the data package provided from the controller 400.

FIG. 11 shows a case in which the length of the horizontal blank field is increased by delaying the length of the horizontal blank field by a positive (+) delay length (for example, the first delay length DT1 and the second delay length DT2). However, the length of the horizontal blank field may be reduced by delaying the length of the horizontal blank field by a negative (−) delay length. In this case, as the data signal is delayed by the negative (−) delay value, the supply timing of the data signal may be accelerated.

The display device according to the embodiments of the present invention may control the output timing of the data signal based on the load of the scan signal and the load of the data signal. Accordingly, the deviation in charging rate of the data signal of the pixels may be reduced, and the display quality may be improved.

However, effects of the present invention are not limited to the above-described effects, and may be variously extended without departing from the spirit and scope of the present invention.

The foregoing detailed descriptions may illustrate and describe the present invention. In addition, the foregoing descriptions merely illustrate and describe the preferred embodiment of the present invention. As described above, the present invention may be used in various different combinations, modifications and environments, and may be changed or modified within the scope of the inventive concept disclosed in this specification, the scope equivalent to the above-described description and/or the scope of technology or knowledge of the art. Therefore, the description is not intended to limit the disclosure to the form disclosed herein. In addition, the appended claims should be construed as including other embodiments.

What is claimed is:

1. A display device comprising:

a pixel unit including a plurality of pixels connected to data lines and scan lines;

a data driver disposed on one side of the pixel unit to drive the data lines;

a scan driver disposed on the one side of the pixel unit together with the data driver to drive the scan lines; and a controller which controls an output timing of a data signal in units of pixel columns and units of pixel rows based on a load of a scan signal supplied to the scan lines and a load of the data signal supplied to the data lines, wherein each of the scan lines includes:

a main scan line extending in a first direction and connected to pixels in a corresponding pixel row among the plurality of pixels;

a first sub-scan line connected to the main scan line at a first contact point and extending in a second direction different from the first direction; and a second sub-scan line connected to the main scan line at a second contact point and extending in the second direction, and wherein each main scan line of the scan lines is connected to at least two sub-scan lines of the scan lines, and wherein the controller adjusts the output timing of the data signal for each of the scan lines based on a distance between a target pixel connected to the main scan line and the first contact point and a distance between the target pixel and the second contact point.

2. The display device of claim 1, wherein the controller controls the output timing of the data signal according to a distance between the scan driver and the main scan line connected to the pixels in the corresponding pixel row.

3. The display device of claim 2, wherein the load of the scan signal increases, as the distance between the scan driver and the main scan line connected to the pixels in the corresponding pixel row increases.

4. The display device of claim 1, wherein the controller adjusts the output timing of the data signal for each of the scan lines according to a position of the target pixel connected to the main scan line in the first direction, and the target pixel is included in the pixels in the corresponding pixel row.

5. The display device of claim 1, wherein the controller controls the output timing of the data signal according to a distance between the data driver and the target pixel connected to the data line among the pixels in the corresponding pixel row.

6. The display device of claim 5, wherein the load of the data signal increases, as the distance between the target pixel and the data driver increases.

7. The display device of claim 1, wherein a length of each of first sub-scan lines and second sub-scan lines of the scan lines in the second direction gradually increases along the first direction.

8. The display device of claim 1, wherein the controller generates a timing control signal for controlling the output timing of the data signal and supplies the timing control signal to the data driver.

9. The display device of claim 8, wherein the data driver delays the data signal by a positive delay value or a negative delay value based on the timing control signal.

10. The display device of claim 9, wherein the data driver delays the data signal by the negative delay value based on the timing control signal when a supply timing of the data signal is later than a supply timing of the scan signal.

11. The display device of claim 9, wherein the data driver delays the data signal by the positive delay value based on the timing control signal when a supply timing of the data signal is earlier than a supply timing of the scan signal.

12. The display device of claim 8, wherein the data driver outputs the data signal without delaying the data signal based on the timing control signal when a supply timing of the data signal and a supply timing of the scan signal coincide with each other.

13. The display device of claim 8, wherein the timing control signal includes a look-up table for storing delay values of the data signal according to relative positions of the plurality of pixels in the pixel unit.

14. The display device of claim 1, wherein the controller sets a predetermined number of adjacent pixel rows among the pixel rows as a pixel row block, the pixel row block being provided in plural, and controls the output timing of the data signal in units of the pixel row blocks.

15. The display device of claim 1, wherein the controller sets a predetermined number of adjacent pixel columns among the pixel columns as a pixel column block, the pixel column block being provided in plural, and controls the output timing of the data signal in units of the pixel column blocks.

16. A display device comprising:

a pixel unit including a plurality of pixels connected to data lines and scan lines;

a data driver disposed on one side of the pixel unit to drive the data lines;

a scan driver disposed on the one side of the pixel unit together with the data driver to drive the scan lines; and a controller which controls an output timing of a data signal in units of pixel columns and units of pixel rows based on a load of a scan signal supplied to the scan lines and a load of the data signal supplied to the data lines, wherein each of the scan lines includes:

a main scan line extending in a first direction and connected to pixels in a corresponding pixel row among the plurality of pixels;

a first sub-scan line connected to the main scan line at a first contact point and extending in a second direction different from the first direction; and a second sub-scan line connected to the main scan line at a second contact point and extending in the second direction, wherein the controller adjusts the output timing of the data signal for each of the scan lines according to a position of a target pixel connected to the main scan line in the first direction, and the target pixel is included in the pixels in the corresponding pixel row, and wherein the controller adjusts the output timing of the data signal based on a distance between the target pixel and the first contact point and a distance between the target pixel and the second contact point.

17. The display device of claim 16, wherein the load of the scan signal increases, as the distance between the target pixel and the first contact point increases or the distance between the target pixel and the second contact point increases.

18. A display device comprising:

a pixel unit including a plurality of pixels connected to data lines and scan lines;

a data driver disposed on one side of the pixel unit to drive the data lines;

a scan driver disposed on the one side of the pixel unit together with the data driver to drive the scan lines; and a controller which controls an output timing of a data signal in units of pixel columns and units of pixel rows based on a load of a scan signal supplied to the scan lines and a load of the data signal supplied to the data lines, wherein the controller generates a timing control signal for controlling the output timing of the data signal and supplies the timing control signal to the data driver, wherein the data driver changes a length of a horizontal blank period based on the timing control signal.

19. The display device of claim 18, wherein the data signal is delayed by a positive delay value when the length of the horizontal blank period increases, and wherein the data signal is delayed by the negative delay value when the length of the horizontal blank period decreases.

* * * * *